US005161129A

United States Patent [19]

Chen et al.

[11] Patent Number: 5,161,129

[45] Date of Patent: Nov. 3, 1992

[54] TIDE WATCH

[75] Inventors: Li Chen; Pyn Maa, both of Taipei, Taiwan

[73] Assignee: Xonix Electronic Watch Enterprise Co., Ltd., Taipei, Taiwan

[21] Appl. No.: 808,871

[22] Filed: Dec. 17, 1991

[51] Int. Cl.[5] ..... G04B 19/26

[52] U.S. Cl. ..... 368/19

[58] Field of Search ..... 368/19

[56] References Cited

U.S. PATENT DOCUMENTS

| | | | |
|---|---|---|---|
| 2,252,074 | 8/1941 | Gulesian | 368/19 |
| 3,708,971 | 1/1973 | Wlodyka | 368/19 |
| 3,825,181 | 7/1974 | Banner | 368/19 |
| 4,623,259 | 11/1986 | Oberst | 368/19 |
| 4,849,949 | 7/1989 | Voth | 368/19 |
| 4,853,907 | 8/1989 | Bourquin et al. | 368/19 |
| 4,993,002 | 2/1991 | Kerr | 368/19 |

*Primary Examiner*—Bernard Roskoski

*Attorney, Agent, or Firm*—Baker, Maxham, Jester & Meador

[57] ABSTRACT

A tide watch having a direct reading high tide indicator and a settable bezel for alignment with the high tide time on the watch dial so that the hour hand always indicates the approximate condition of the tide. The watch dial is formed with a semi-circular opening having indicia therearound to represent the tide times. A disc is mounted beneath the watch dial having indicia thereon which are settably aligned with the index marks around the semi-circular opening for setting of the local higher high tide condition. The high tide indicator on the bezel can be aligned with the expected high tide time on the watch dial so that the hour hand will always provide an approximation of the current condition of the tide at any time it is viewed.

4 Claims, 2 Drawing Sheets

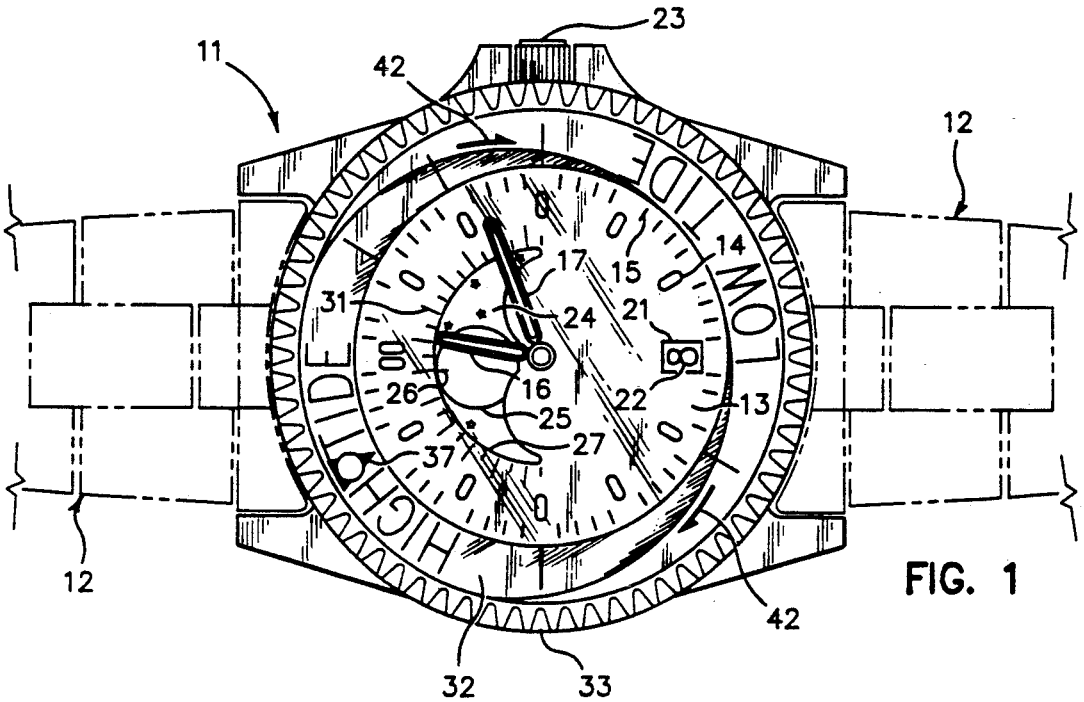
FIG. 1
FIG. 2
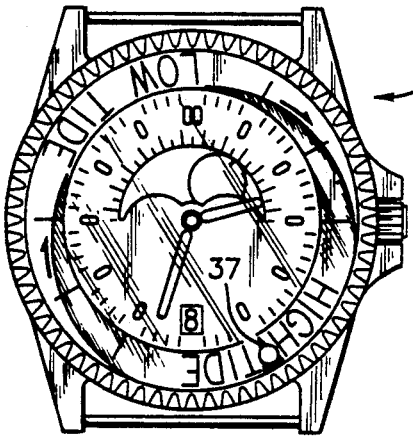
FIG. 3
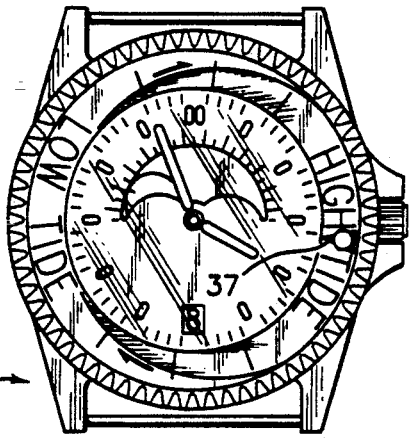
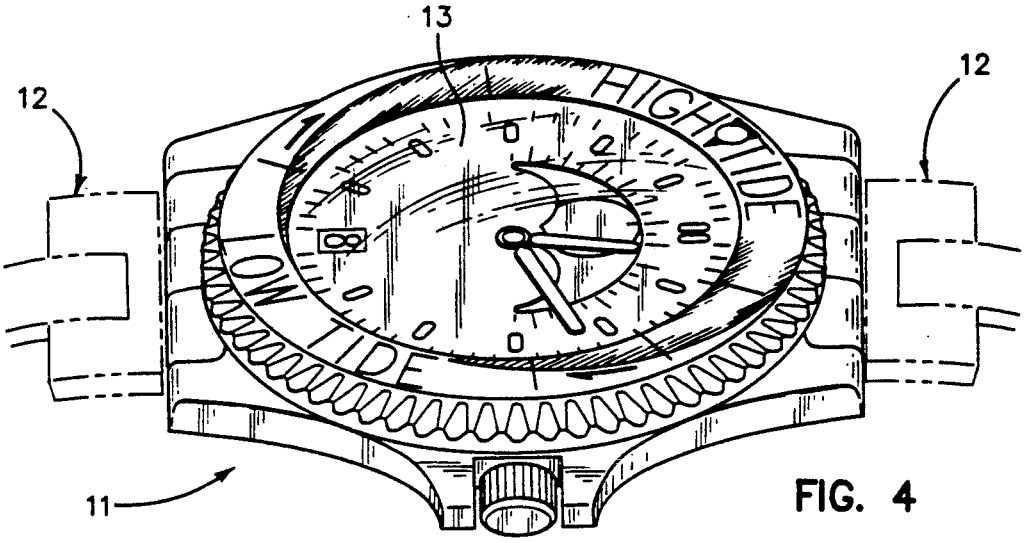
FIG. 4

TIDE WATCH

FIELD OF THE INVENTION

This invention relates generally to horological instruments and more particularly to a watch for indicating tide times along with normal time indications.

BACKGROUND OF THE INVENTION

Timepieces which are modified and adapted to show the local tides and possibly moon conditions have been the subject of development for many years. Patents showing such devices range from Haynes U.S. Pat. No. 2,677,928, filed in 1949, through Bourquin et al. U.S. Pat. No. 4,853,908 issued in 1989. Most of the prior art patents relate to the mechanisms for driving the appropriate indication elements such as dials and pointers as additional elements to the standard timekeeping mechanism. Some of these devices are quite complex and provide a great deal of detailed information. For example, see U.S. Pat. Nos. 3,745,313, 4,623,259 and 4,849,949. A programmable electronic tide clock is shown in U.S. Pat. No. 4,412,749.

U.S. Pat. No. 4,853,908 is of interest and will be considered here in some detail. The moon face and relative tide indicating disc is mounted to the timing mechanism for rotation through one complete day's cycle which Borquin states as occurring every 24 hours and 50 minutes. The position of the moon indicator with respect to a centered position or high tide index enables the user to calculate the next or last high tide time. By viewing the face of the watch the user can count the hours to the next high or low tide. A second rotating disc provides the indication of moon phase in conjunction with tide times. One drawback of this particular watch is that in order to fully set the watch and the moon phase, several minutes and many rotations of the crown are necessary. Another is that tide time is not instantly shown but must be calculated by the user.

SUMMARY OF THE INVENTION

Broadly speaking, the present invention employs a horological instrument having means in addition to the normal timekeeping functions for rotation every 58.8 days, together with unique indicia and a rotatable bezel which makes the watch very effective, attractive, simple to set and operate and instantaneously provide high tide information at a glance without the need for any calculation.

The watch face, behind which is mounted the classic or standard timing movement or mechanism, which may be either mechanical or electrical, has the usual indications for hours, minutes and seconds as desired. A window is optionally provided for date indication. Another arcuate or semicircular opening, having index lines evenly spaced therearound, enables viewing through that opening of a portion of a tide indicator disc having an indicator line for successive alignment with the index lines around the opening. Once set, the highest high tide for each day is indicated by the alignment of the indicator line with one of the index lines. A rotatable bezel having high tide and low tide indicators and directional indicators to show the direction the tide is tending is mounted to the peripheral circumference of the watch case. Once the tide disc is set by means of the watch setting crown for the local area at the time of highest high tide, the rotatable bezel can be moved so that the high tide indicator is opposite the watch face time of that high tide which is indicated in the arcuate area in the watch face. The hour hand of the watch in conjunction with graphics on the bezel which show ebbing or flooding tide, indicate the exact condition of the tide at any particular time, and the direction in which it is tending.

BRIEF DESCRIPTION OF THE DRAWING

The objects, advantages and features of this invention will become more clearly apparent from the following detailed description, when read in conjunction with the accompanying drawing, in which:

FIG. 1 is a front view of the tide watch of the invention;

FIG. 2 shows the front of the invention of FIG. 1 on a smaller scale with the time, tide and moon indicators at a different position;

FIG. 3 is another front view similar to FIG. 2 showing the time, tide and moon indicators at still another position;

FIG. 4 is front perspective view of the tide watch of FIG. 1;

DESCRIPTION OF THE PREFERRED EMBODIMENTS

Figure 5:
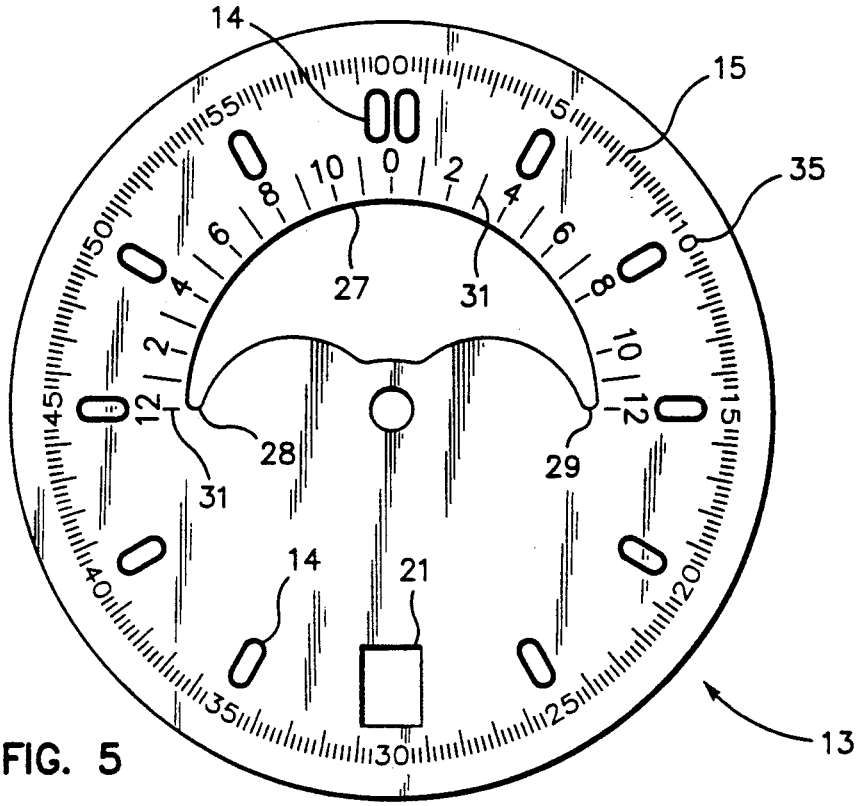
FIG. 5 is an enlarged plan view of the watch dial or time indicating face of the invention shown in FIG. 1.

With reference now to the drawing, and more particularly to FIGS. 1–4, watch 11 is shown with a typical watch band 12 mounted thereto in FIGS. 1 and 4. The watch timing mechanism is not shown and is not the subject of this invention. A moon phase time movement can be purchased from Citizen Watch Company from Japan, which is suitable for use with the invention. The movement is mounted within the watch case behind face 13 having hour indicators 14 and minute indicating lines 15 arranged around the periphery of the face. Hour hand 16 and minute hand 17 are mounted in the usual manner and cooperate with the hour and minutes indicator elements to provide the usual time indication. A second hand may be provided. Opening 21 at the bottom of the face may be employed to provide a date indication as indicated by the numeral 22 appearing in window 21. The watch or timing mechanism includes the usual setting means comprising a stem (not shown) to which is mounted crown 23. The crown has two stop positions. The first position enables the setting of the moon phase indicator and the second or outer stop enables setting of the time visually by means of the hour and minute hands.

Behind watch face 13 and mounted to the timing mechanism for rotation every 58.8 days is moon indicator disc 24. This disc incorporates several stars in the background for aesthetic purposes and has two oppositely positioned moon representing, contrasting color discs 25, each having an indicator line 26 thereon. Arranged around semicircular opening 27 in face 13 are index lines 31 which are evenly spaced and preferably represent the 24 hours in the day. These will be discussed in more detail with respect to FIG. 5.

Mounted to the watch case and surrounding the front periphery of the dial is rotatable bezel 32. This bezel is preferably ratcheted so that it can only turn in one direction, normally the counterclockwise direction.

The periphery of the bezel is knurled, as indicated by notches and ridges 33, to facilitate its rotation. The details of the bezel and the indicia thereon and their functions will be described more fully with respect to FIG. 6.

With the aid of local tide tables, the tide indicator, by means of crown 23, can be set to indicate the higher high tide for that particular day at that location. That should be done at approximately the time of that tide. Once that is set, which is a simple matter of a single partial rotation to position indicator line 26 with an appropriate index line 31, the external bezel can be rotated so that high tide indicator 37 aligns with the hour location on the watch dial for that day's higher high tide. Thereafter, by viewing the face of the watch, the user is enabled to immediately determine the time of the next high tide and the current condition of the tide by the interrelationship between the indicia around semicircular opening 27, the moon indicator 25 and 26, and the indicia on bezel 32.

With reference now to FIG. 5, there is shown watch face or dial 13 having the indicia previously described but shown in more detail. Minute indicators 15 are shown with numerals 35, which could also be cooperatively used with a second hand if the watch is so provided. Index lines 31 around semicircular opening 27 show the numerals ranging from the left terminus 28 of the opening to the central or halfway point thereof, counting the hours from 0 to 12 noon and from 12 noon, which is represented by a "0," to 12 midnight at the right terminus 29 of the opening. For purposes of balance, the left indicator line also includes the number "12" to indicate that the opposite "12's" both indicate midnight and are functionally equivalent.

Indicator line 26 (see FIG. 1) on moon element 25 is initially positioned with respect to an index line 31 for the current highest high tide in the local area. If that high tide is in the morning, the moon disc 25 and indicator line 26 will be aligned at the left side of the semicircular opening in alignment with the time of that high tide. Conversely, if that high tide for the particular day in question is in the afternoon, then indicator line 26 will be aligned with the appropriate hour on the right side of the semicircular opening.

Figure 6:
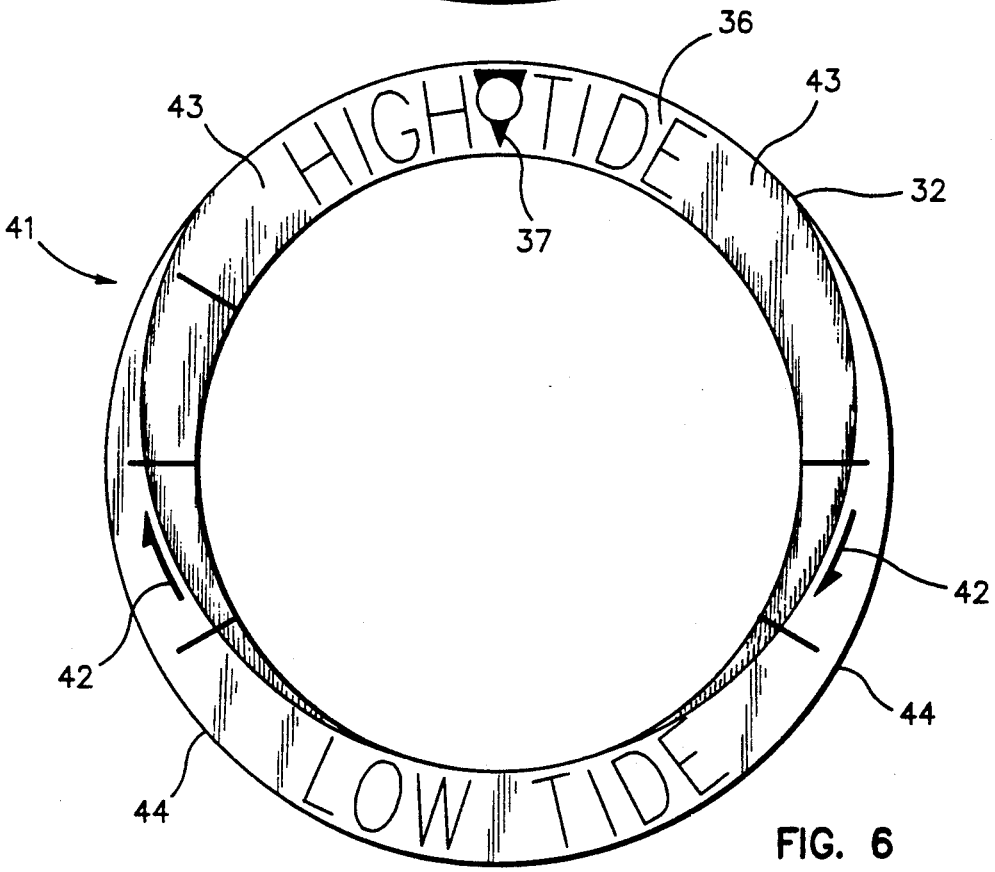
FIG. 6 is the graphics and indicator portion of the rotatable bezel of the invention of FIG. 1.

Bezel 32 is shown on an enlarged scale in FIG. 6, which includes only the indicia and graphics, without the knurled outer surface. The words "HIGH TIDE" 36 include high tide position indicator 37 on one side and the words "LOW TIDE" 41 appear on the opposite side of the annular bezel. Arrows 42 on either side of the bezel between the "HIGH TIDE" and "LOW TIDE" words indicate the direction of movement of the tide with respect to the time on the watch face and the graphics on the bezel. Area 43, which includes the words "HIGH TIDE" and the high tide indicator point, is formed of a contrasting color with respect to area 44, which area includes the words "LOW TIDE" at the opposite side of the bezel. This is a graphic visual indication of the condition of the tide. For example, at high tide, area 43 extends completely across the front surface of the bezel annulus in a radial direction. At a point approximately half way between high tide and low tide, the area 43 is shown as continuously diminishing and extends only a portion of the radial dimension across the bezel. This diminishing representation continues until area 43 disappears shortly before the low tide indication and starts expanding again between the low tide and the high tide marks. This is a very graphic representation of the tide condition because low tide may be considered a zero point and at all other times not immediately before or after low tide, there is some tide higher than low tide. It should be noted that the position of bezel 32 and indicator 37, once they are set for the day's higher high tide, will be generally useful in identifying the time of the next lower high tide and the tide conditions in between, as the hours pass. For accuracy, the bezel should be set each day for the higher high tide that day, as indicated by indicator line 26.

Specific settings of the tide watch of the invention will now be discussed with respect to FIGS. 1–4. In FIG. 1 the higher high tide for the current day is shown as occurring at 11 a.m. by the fact that indicia 26 is aligned with the index line 31 representing 11 o'clock, which is one space to the left of the "0" or noon indicator. The bezel would be rotated, normally counterclockwise, so that high tide indicator 37 aligns with 11 a.m. on the watch dial. Since the watch time indicates about 11 minutes after 12 on the eighth of the month, it must be assumed that this is shortly after noon and that the higher high tide for that day has recently occurred. With high tide indicia 37 aligned with 11 a.m. on the watch dial, it is immediately apparent that the tide at the particular time indicated in the watch, slightly after noon, is receding because hour hand 16 is past high tide indicia 37 and proceeding in a direction of arrow 42. It is also apparent that the graphics on the bezel will give a generally useful condition of the tide at any time that day, including the second, or lower, high tide. Tide indicia 26 will accurately indicate the time of the higher high tide in the local area as each day rolls around. The bezel can be set to the proper time any day as desired, based on the position of indicia 26.

With reference to FIG. 2, indicator line 26 shows the higher high tide to be at approximately 5 p.m. By aligning high tide indicator 37 with 5 p.m. on the watch dial, and given that the current time shown is approximately 2:30, it would mean that the hour hand is approaching a new high (indicator 37) tide as indicated by the fact that area 43 is nearly as wide as the annulus of bezel 32 at the position of the hour hand, and that, in the direction of arrow 42, the hour hand is approaching high tide mark 37.

FIG. 3 shows by indicator line 26 that the higher high tide that day was at approximately 3:15 a.m. Since the watch shows a time of just before 4 o'clock, that must indicate 4 a.m. and that there are nearly twelve hours before the next high tide. FIG. 4 is substantially the same representation with respect to time and tide as FIG. 1.

In view of the above description, it is likely that modifications and improvements will occur to those skilled in the art which are within the scope of the present invention as defined by the accompanying claims. For example, it is generally preferred to set the watch to the periodic higher high tide times, but it could just as well be set to the lower high tides. It is a matter of preference and one or the other should be consistently chosen.

What is claimed is:

1. A tide watch comprising:

a case;

a timing mechanism within said case having a minute hand and a hour hand and including conventional timekeeping, time setting, gearing and related apparatus, and including means for rotation on a period of 58.8 days;

a time indicating dial mounted to said case in cooperative relationship with said minute and hour hands;

a semi-circular opening in one portion of said dial;

evenly spaced index lines arranged around said opening with a neutral indication {"0"} at the top center, said index lines around said opening indicating an equal number of time periods on either side of said neutral indication {"0"};

a tide indicator disc mounted beneath said dial and connected for rotation to said timing mechanism for one complete revolution every 58.8 days, said disc having thereon indicia cooperatively interrelating with said index lines to show tide times by direct reading; and a tide indicator bezel mounted to said housing for selective independent rotation about said dial, said bezel having an upper surface which includes indicia showing fullness at high tide time and being graduated to indicate emptiness at low tide time, with a continuous gradual indication of diminishment between the high tide and low tide times in interrelationship with said hour hand.

2. The tide watch recited in claim 1, wherein said disc has imprinted thereon two circles at 180° spacing, each circle moving through said opening during the course of 29.4 days, each said circle having a single line said indicia thereon which consecutively aligns with said index lines to provide a continuously moving specific time indication of the higher high tide for the current day.

3. A tide watch comprising:

a case;

a timing mechanism within said case having a minute hand and a hour hand and including conventional timekeeping, time setting, gearing and related apparatus, and including means for rotation on a period of 58.8 days;

a time indicating dial mounted to said case in cooperative relationship with said minute and hour hands;

a semi-circular opening in one portion of said dial;

evenly spaced index lines arranged around said opening with "0" at the top center, said index lines around said opening indicating twelve hours on either side of the "0";

a tide indicator disc mounted beneath said dial and connected for rotation to said timing mechanism for one complete revolution every 58.8 days, said disc having thereon indicia cooperatively interrelating with said index line to show tide times by direct reading, said disc having imprinted thereon two circles at 180° spacing, each circle moving through said opening during the course of 29.4 days, each said circle having a single line said indicia thereon which consecutively aligns with said index lines to provide a continuously moving specific time indication of the higher high tide for the current day; and a tide indicator bezel mounted to said housing for selective independent rotation about said dial, said bezel having a high tide indicia selectively cooperatively interrelating with said time indicating dial and being selectively set for each day's higher high tide with said high tide indicia aligned with the high tide time on said dial, said bezel having an upper surface which includes indicia showing fullness at high tide time and being graduated to indicate emptiness at low tide time, with a continuous gradual indication of diminishment between high tide and low tide times.

4. A tide watch comprising:

a case;

a timing mechanism within said case having a minute hand and a hour hand and including conventional timekeeping, time setting, gearing and related apparatus, and including means for rotation on a period of 58.8 days;

a time indicating dial mounted to said case in cooperative relationship with said minute and hour hands;

a semi-circular opening in one portion of said dial;

evenly spaced index lines arranged around said opening with a neutral indication at the top center, said index lines around said opening indicating an equal number of time periods on either side of said neutral indication;

a tide indicator disc mounted beneath said dial and connected for rotation to said timing mechanism for one complete revolution every 58.8 days, said disc having thereon indicia cooperatively interrelating with said index lines to show tide times by direct reading; and a tide indicator bezel mounted to said housing for selective independent rotation about said dial, said bezel having a high tide indicia selectively cooperatively interrelating with said time indicating dial and being selectively set for each day's higher high tide with said high tide indicia aligned with the high tide time on said dial, said bezel having an upper surface which includes indicia showing fullness at high tide time and being graduated to indicate emptiness at low tide time, with a continuous gradual indication of diminishment between the high tide and low tide times in interrelationship with said hour hand.

* * * * *

UNITED STATES PATENT AND TRADEMARK OFFICE

CERTIFICATE OF CORRECTION

PATENT NO. : 5,161,129
DATED : November 3, 1992
INVENTOR(S) : Li Chen, et. al.

It is certified that error appears in the above-indentified patent and that said Letters Patent is hereby corrected as shown below:

Claim 1, column 5, line 5, delete "{"0"}"; and line 8, delete "{"0"}".

Signed and Sealed this

Nineteenth Day of October, 1993

*Attest:*

*Attesting Officer*

BRUCE LEHMAN

*Commissioner of Patents and Trademarks*